US010760238B2

(12) United States Patent
Herdman et al.

(10) Patent No.: US 10,760,238 B2
(45) **Date of Patent: *Sep. 1, 2020**

(54) PROTECTIVE POLE CAP

(71) Applicant: Osmose Utilities Services, Inc., Peachtree City, GA (US)

(72) Inventors: Douglas Joseph Herdman, Fayetteville, GA (US); Randy Carl Marquardt, Peachtree City, GA (US); David Gordon Smith, Griffin, GA (US)

(73) Assignee: Osmose Utilities Services, Inc., Peachtree City, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/298,517

(22) Filed: Mar. 11, 2019

(65) Prior Publication Data

US 2019/0203438 A1 Jul. 4, 2019

Related U.S. Application Data

(63) Continuation of application No. 15/444,401, filed on Feb. 28, 2017, now Pat. No. 10,227,747.

(51) Int. Cl.

| | |
|---|---|
| ***B32B 3/00*** | (2006.01) |
| ***E02D 5/22*** | (2006.01) |
| ***E04H 12/00*** | (2006.01) |
| ***E04H 17/00*** | (2006.01) |
| ***E04C 3/30*** | (2006.01) |
| ***E04C 5/16*** | (2006.01) |

(Continued)

(52) U.S. Cl.

CPC ..... *E02D 5/226* (2013.01); *E02D 5/223* (2013.01); *E04C 3/30* (2013.01); *E04C 5/161* (2013.01); *E04H 12/00* (2013.01); *E04H 17/00* (2013.01); *E04H 17/20* (2013.01); *E04C 3/36* (2013.01); *E04H 2017/006* (2013.01); *Y10T 428/24008* (2015.01)

(58) Field of Classification Search

CPC . Y10T 428/24008; E02D 5/226; E02D 5/223; E04C 3/30; E04C 5/161; E04H 12/00; E04H 17/20; E04H 2017/006

See application file for complete search history.

(56) References Cited

U.S. PATENT DOCUMENTS

| | | | |
|---|---|---|---|
| 1,657,127 | A | 1/1928 | Kibbey |
| 1,996,400 | A | 4/1935 | Bowen |
| 1,996,401 | A | 4/1935 | Bowen |

(Continued)

OTHER PUBLICATIONS

Pole Topper Pole Top Protection. Datasheet [online]. Osmose. [retrieved on Sep. 18, 2017]. Retrieved from the Internet: <URL:www.osmose.com/documents/Pole%20Topper%20product%20bulletin%202016.pdf>.

(Continued)

*Primary Examiner* — Alexander S Thomas

(74) *Attorney, Agent, or Firm* — Troutman Pepper Hamilton Sanders LLP

(57) ABSTRACT

An example embodiment of the present invention provides a pole cap for covering an end of a pole. The pole cap comprises a sheet that includes a central portion, a first strip, and a flap that has a slit. The central portion is configured to cover a base surface of an end of a pole. The first strip is configured to fold over an edge of the base surface and circumferentially wrap around a portion of a curved surface of the pole. The flap is configured to fold over the edge of the base surface.

18 Claims, 4 Drawing Sheets

(51) Int. Cl.
*E04H 17/20* (2006.01)
*E04C 3/36* (2006.01)

(56) References Cited

U.S. PATENT DOCUMENTS

| | | | |
|---|---|---|---|
| 2,139,422 | A | 12/1938 | Schmittutz |
| 2,710,996 | A | 6/1955 | Pittman |
| 3,250,050 | A | 5/1966 | Finger et al. |
| 3,319,328 | A | 5/1967 | Finger et al. |
| 3,319,332 | A | 5/1967 | Finger et al. |
| 3,352,581 | A | 11/1967 | Robbins et al. |
| 3,448,585 | A | 6/1969 | Volgelsang |
| 3,746,776 | A | 7/1973 | Monahan et al. |
| 4,161,090 | A | 7/1979 | Watts, Jr. |
| 4,245,931 | A | 1/1981 | Watts, Jr. |
| 4,312,162 | A | 1/1982 | Medney |
| 4,789,579 | A | 12/1988 | Tutas et al. |
| 4,799,340 | A | 1/1989 | Lichau et al. |
| 5,339,594 | A | 8/1994 | Ventura-Berti |
| 5,466,094 | A | 11/1995 | Kirby et al. |
| 5,553,438 | A | 9/1996 | Hsu |
| 6,006,479 | A | 12/1999 | Fayle |
| 9,540,839 | B1 | 1/2017 | Gross |

OTHER PUBLICATIONS

Pole Conservation & Repair Products. Osmose. [retrieved on Sep. 18, 2017]. Retrieved from the Internet: <URL:www.web.archive.org/web/19990418012501/http://www.osmose.com:80/utilities/u_matsales.htm>.

PROTECTIVE POLE CAP

CROSS-REFERENCE TO RELATED APPLICATIONS

This application is a continuation of U.S. patent application Ser. No. 15/444,401, filed 28 Feb. 2017, now U.S. Pat. No. 10,227,747 the contents of which are incorporated herein by reference as if presented in full.

TECHNICAL FIELD OF THE INVENTION

The various embodiments of the present disclosure relate generally to protective devices for the tops of poles. More particularly, the various embodiments of the present invention may be directed to the tops of utility poles, pilings, fence posts, and the like.

BACKGROUND

The tops of wooden poles can deteriorate due to fungus decay or exposure of the wooden pole to weather elements. A primary cause of this deterioration is the entry of moisture at end surfaces of the poles due to the exposed end grains. Water can collect in slight depressions of an end of the pole, which can be caused by decay, and the water can cause wood fibers to shrink and swell and/or freeze and thaw. Cracks may develop which can eventually allow moisture and decay to travel beyond any original treatment to the wood, breaking down additional wood fibers. If wooden poles are neglected, decay may become severe enough to necessitate replacement of the pole.

Previous attempts to protect pole tops from deterioration include cover caps, such as those composed of polyvinylchloride (PVC) material. Installation of these cover caps generally requires them to be nailed to the tops of poles, which may prove dangerous, as use of a hammer and nails may be required near live electrical wires. Additionally, these cover caps are generally provided in different sizes to fit different size poles, requiring a stock of different sized cover caps to be carried in the field in order to accommodate a variety of pole sizes.

Another attempt requires a protective fluid to be poured over the top end of a utility pole, after which a flowable asphalt-based material must be applied to the top of the utility pole. The asphalt-based material must then be allowed to cure. This method may be cumbersome, time consuming, and messy.

Another method that attempts to protect pole tops from deterioration includes the on-site manufacture of a synthetic resin cap that includes an end plate covering the end surface of the pole and a skirt that extends downwardly from the end plate and around the pole. A foamed resin may also be applied between the cap and the pole to prevent entrance of moisture. This method may be difficult and time consuming.

Another attempt requires application of a preformed cap that is made of elastic and water-impervious material to the top of a pole. To accomplish this, however, a frame must be used to position and apply an outwardly stretched cap to the top end of the pole. To attach the cap to the top of the pole, the frame must then release the cap, allowing the cap to contract to attach the cap to the top of the pole. Such caps may not adequately seal to prevent the entrance of moisture to the top end of the pole. Furthermore, there may be an increased danger of accidentally touching live electrical wires due to the difficulty and awkwardness presented by the application method of these caps.

Another method is a moisture barrier comprising a sheet of moisture-adverse material that can be adhered to the top end of a pole. In such a method, the sheet is configured to fold about the edge of the pole's end. Existing methods, however, may not be configured to provide a tight fit to the end of the pole, creating a discrepancy between the geometry of the end of the pole and the geometry of the moisture barrier. Such a discrepancy may increase the likelihood of a breach in the seal of the moisture barrier, thus allowing the entrance of moisture to the top end of the pole.

Therefore, there is a desire for a protective pole cap that may be installed easily, quickly, and safely. Further, there is a desire for a single-sized pole cap that will snugly fit a variety of sizes of poles. Various embodiments of the present invention address these desires.

SUMMARY

The present invention relates to protective devices for the tops of poles, including utility poles, pilings, and fence posts. An example embodiment of the present invention provides a pole cap for covering an end of a pole. The pole cap can comprise a sheet that can include a central portion, a first strip, and a flap that comprises a slit. The central portion can be configured to cover a base surface of an end of a pole, and the first strip can be configured to fold over the edge of the end of the pole and circumferentially wrap around a portion of the curved surface of the pole. The flap can be configured to fold over an edge of the base surface.

In some embodiments of the present invention, the sheet may further comprise an adhesive.

In some embodiments of the present invention, the adhesive may be an adhesive film.

In some embodiments of the present invention, the flap may have a first portion located on one side of the slit and a second portion located on the other side of the slit. The first portion may be configured to overlap at least some of the second portion when the flap is folded over the edge of the base surface.

In some embodiments of the present invention, the slit may be a V-shaped cut.

In some embodiments of the present invention, the flap can overlap at least some of the first strip.

In some embodiments of the present invention, the sheet may comprise a second strip. The first strip and the second strip may both comprise a tab, and the second strip may be configured such that the tab of the second strip overlaps at least a portion of the tab of the first strip.

In some embodiments of the present invention, the sheet can be composed of a moisture-resistant material.

In some embodiments of the present invention, the sheet can be composed of a plastic.

In some embodiments of the present invention, the sheet can be composed of polyethylene.

In some embodiments of the present invention, the sheet can be composed of butyl rubber.

In some embodiments of the present invention, the pole cap can comprise a sheet that can include a central portion, a first strip, and a flap that comprises a slit. The central portion can be configured to cover a base surface of an end of a pole, and the first strip can be configured to fold over the edge of the end of the pole and circumferentially wrap around a portion of the curved surface of the pole. The sheet can include a first cutout that separates at least a part of the central portion and at least a part of the first strip. The flap can be configured to fold over an edge of the base surface.

A pole cap for covering an end of a pole comprising:

In some embodiments of the present invention, at least a part of the first cutout can be angled inwardly toward the central portion.

In some embodiments of the present invention, the flap may comprise a slit.

In some embodiments of the present invention, the flap may comprise a V-shaped cut.

In some embodiments of the present invention, the sheet may comprise a second strip and a second cutout separating at least a part of the central portion and at least a part of the second strip. The first strip and the second strip may both comprise a tab, and the second strip may be configured such that the tab of the second strip overlaps at least a portion of the tab of the first strip.

These and other aspects of the present invention are described in the Detailed Description of the Invention below and the accompanying figures. Other aspects and features of embodiments of the present invention will become apparent to those of ordinary skill in the art upon reviewing the following description of specific, example embodiments of the present invention in concert with the figures. While features of the present invention may be discussed relative to certain embodiments and figures, all embodiments of the present invention can include one or more of the features discussed herein. Further, while one or more embodiments may be discussed as having certain advantageous features, one or more of such features may also be used with the various embodiments of the invention discussed herein. In similar fashion, while example embodiments may be discussed below as device, system, or method embodiments, it is to be understood that such example embodiments can be implemented in various devices, systems, and methods of the present invention.

BRIEF DESCRIPTION OF THE DRAWINGS

The following Detailed Description is better understood when read in conjunction with the appended drawings. For the purposes of illustration, example embodiments are shown in the drawings, but the subject matter is not limited to the specific elements and instrumentalities disclosed.

DETAILED DESCRIPTION

To facilitate an understanding of the principles and features of the present invention, various illustrative embodiments are explained below. To simplify and clarify explanation, the invention is described below as applied to protective covers for utility poles. One skilled in the art will recognize, however, that the invention is not so limited. Instead, as those skilled in the art would understand, the various embodiments of the present invention also find application in other areas, including, but not limited to, pilings, fence posts, and the like.

The components, steps, and materials described hereinafter as making up various elements of the invention are intended to be illustrative and not restrictive. Many suitable components, steps, and materials that would perform the same or similar functions as the components, steps, and materials described herein are intended to be embraced within the scope of the invention. Such other components, steps, and materials not described herein can include, but are not limited to, similar components or steps that are developed after development of the invention.

Figure 1A:
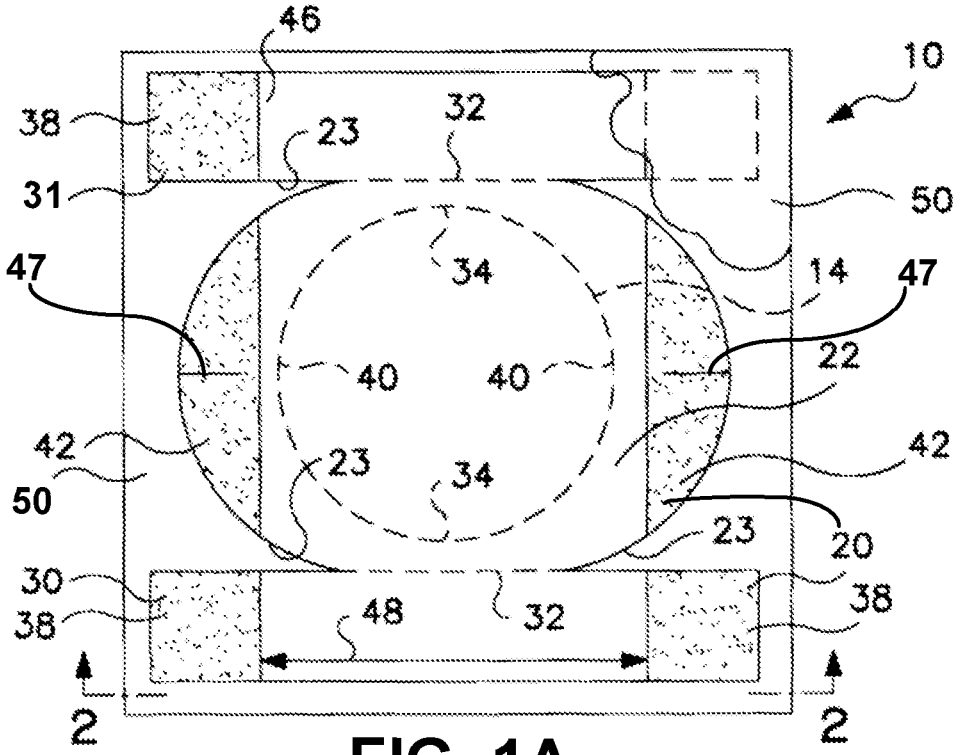
FIG. 1A provides a plan view of a pole cap prior to installation, in accordance with an example embodiment of the present invention.
Figure 1B:
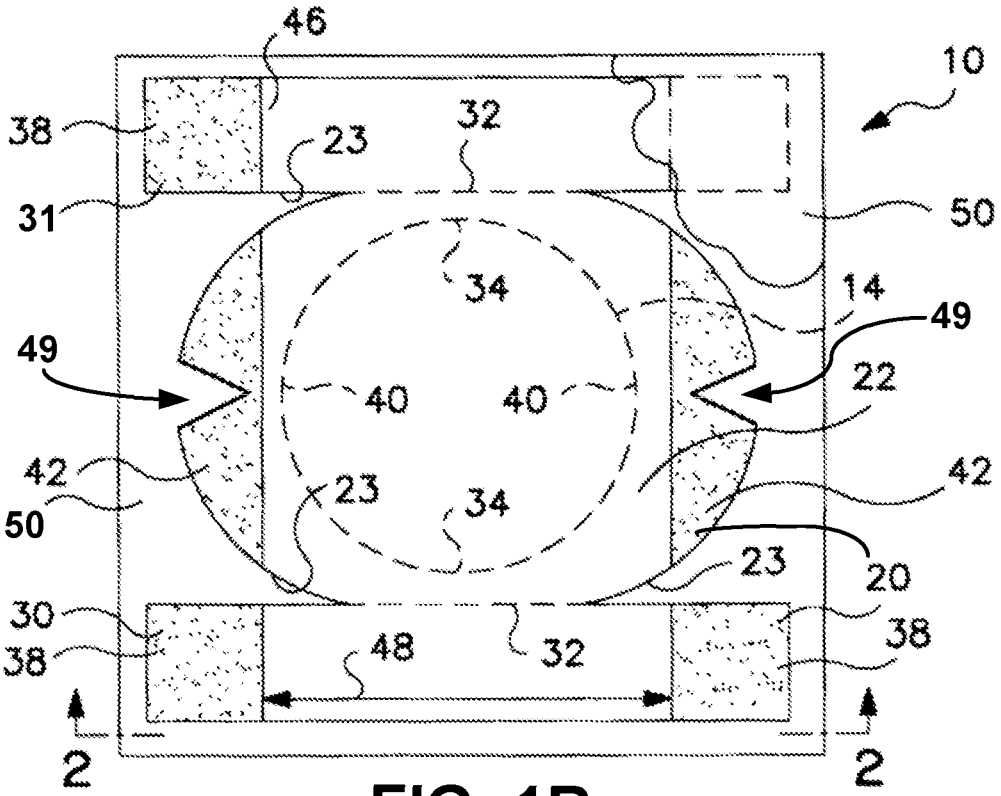
FIG. 1B provides a plan view of a pole cap prior to installation, in accordance with an example embodiment of the present invention.

As shown in FIG. 1, an example embodiment of the present invention provides a protective pole cap 10 that can be applied to the top end 12 of a utility pole 14, providing a moisture barrier for the upper end surface 16 of the utility pole 14. In certain embodiments, the pole cap 10 may include a first layer 20 and a second layer 22, which are preassembled such that the pole cap 10 can be quickly and easily applied to the top end 12 of a utility pole 14. Alternatively, the pole cap 10 may be formed from a single layer.

In certain embodiments, the first layer 20 may be composed of a moisture-resistant material. The moisture-resistant material may provide protection from the effects of ultraviolet light. The first layer 20 can have a central portion 24, which can overlay the upper end surface 16, and flaps 42 that can be folded downwardly from the top of the utility pole 14. The flaps 42 may assist in securing the pole cap 10 to the top end 12 of the utility pole 14.

In some embodiments, the first layer 20 may be composed of an integral adhesive material, which may be elastomeric or rubber-like such that it is stretchable during application. For instance, an example embodiment comprises upper surface 26 and lower surface 28, both of which are adhesive. In some embodiments, the first layer 20 is composed of an integral material or at least in part of an integral material. As used herein (unless otherwise noted), the term "integral" refers to a material that is not readily flowable or smearable. Accordingly, even an integral material such as an adhesive, which may be sticky, would not readily smear onto a person handling it. This is in contrast to asphalt or tar-based materials, which may readily smear onto a person handling them. In some embodiments, the integral material is butyl rubber, which is polyisobutylene to which isoprene is added during manufacture.

Figure 3:
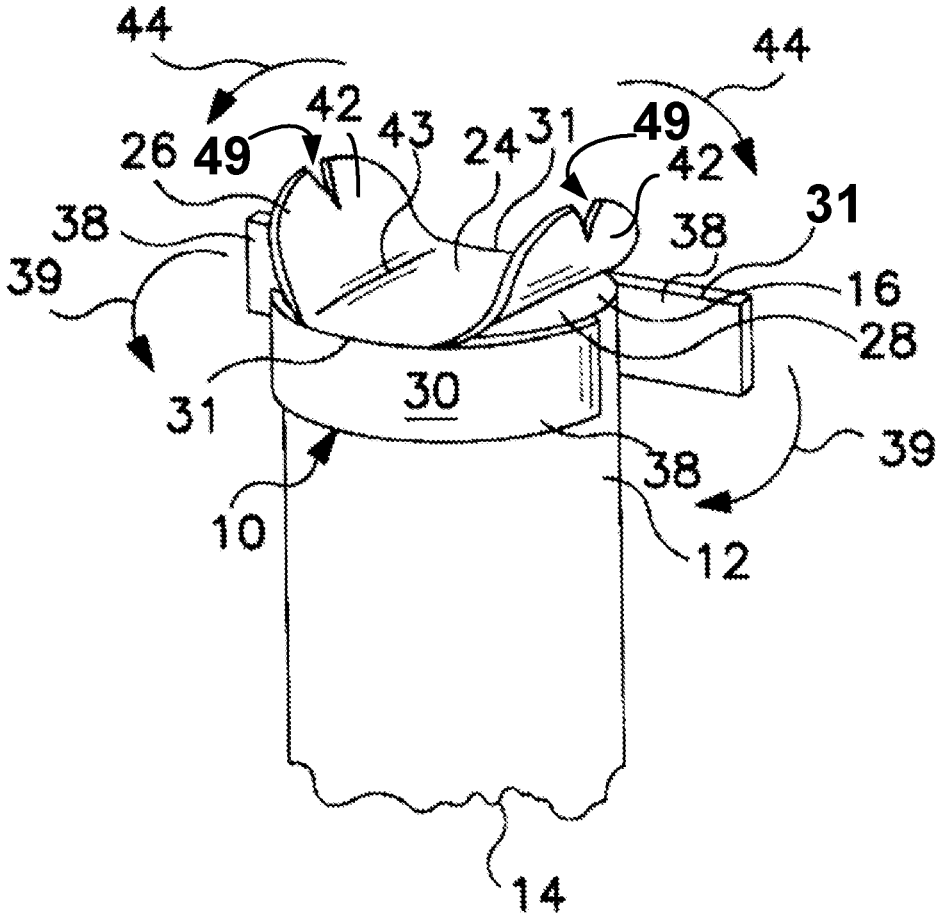
FIG. 3 provides a perspective view of a pole cap being installed on a pole, in accordance with an example embodiment of the present invention.
Figure 4:
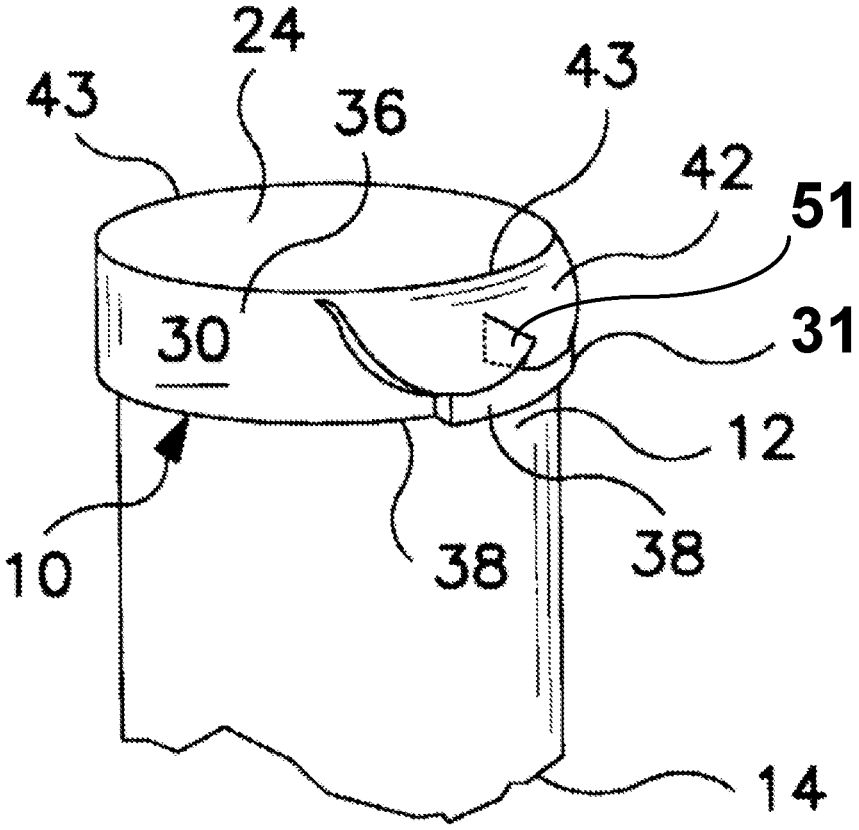
FIG. 4 provides a perspective view of a pole cap as installed on a pole, in accordance with an example embodiment of the present invention.

An example embodiment comprises a first strip 30, which may extend from the central portion 24. In certain embodiments, a second strip 31 may extend from the opposite side of the central portion 24. The first strip 30 and second strip 31 may be foldable downwardly along fold lines 32, such that the first strip 30 and second strip 31 can lie along, and adhere to, the curved, circumferential surface of the utility pole 14. The first strip 30 and second strip 31 may comprise a central section 36 and a tab 38 on either side, or both sides, of the central section 36. The tabs 38 may be wrapped around a portion of the circumference of the utility pole 14, as illustrated by arrows 39 (see FIG. 3). In some embodiments, some or all of the tabs 38 are adhered to the curved surface of the utility pole 14 such that the first strip 30 and/or second strip 31 are pulled taut along the circumference of the utility pole 14. In some embodiments, the dimensions of the first strip 30 and/or second strip 31 are such that a tab 38 of the first strip 30 can overlap a tab 38 of the second strip 31 (or vice versa), as shown in FIG. 4.

In certain embodiments, a flap 42 may extend from the central portion 24. In certain embodiments, the flap 42 has an arcuate edge. The flap 42 may comprise one or more notches or slits 47, which may eliminate or reduce ripples or ridges in the flap 42 upon application of the pole cap 10 to the utility pole 14. During application, the area of the flap 42 to one side of the slit 47 may first be applied, and the area of the of the flap 42 to the other side of the slit 47 may be subsequently applied, such that an overlap 51 may be formed, as shown in FIG. 4.

In certain embodiments, the slit 47 may be a straight cut that is generally perpendicular to the outermost tangent of to the edge of the flap 42. Alternatively, the slit 47 may be a straight cut having an angle less than 90 degrees, such as an angle in the range of 5 to 20 degrees. Some embodiments may comprise an angle in the range of 21 to 45 degrees; some embodiments may comprise an angle in the range of 46 to 89 degrees. In some embodiments, the slit 47 may extend across the entire width of the flap 42, such that the slit 47 extends from the edge of the flap 42 toward the central portion 24. In some embodiments, the slit 47 extends only partially across the width of the flap 42, such as one-half or three-fourths of the width of the flap 42.

In some embodiments, the slit may be more substantial, forming a V-shaped cut 49. Various embodiments may include various sizes and geometries of a V-shaped cut 49, all of which are herein contemplated. For instance, the V-shaped cut 49 may extend across the entire width of the flap 42, such that the V-shaped cut 49 extends from the edge of the flap 42 toward the central portion 24. Alternatively, the V-shaped cut 49 extends only partially across the width of the skirt portion 76, such as one-half or three-fourths of the width of the flap 42.

The geometry of the V-shaped cut 49 may vary, depending on the embodiment. The V-shaped cut 49 may form a generally triangular shape having a vertex angle, which is defined as the vertex nearest the central portion 24. The vertex angle may be a variety of angles. For instance, some embodiments may have a vertex angle that is acute. Certain embodiments may have a vertex angle in the range of 5 to 30 degrees, while some embodiments may have a vertex angle in the range of 31 to 60 degrees. Some embodiments may have a vertex angle in the range of 61 to 89 degrees. It should be noted that any variation in the degree of the vertex angle is herein contemplated.

By varying the distance that the slit 47 or V-shaped cut 49 cuts into the skirt portion 76 and/or the degree of the vertex angle, the amount of overlap 51 can be controlled.

In some embodiments, the flap 42 may include two V-shaped cuts 49, such that a general M-shape is achieved. Some embodiments may include several V-shaped cuts 49, such that a saw-tooth pattern is achieved at the edge of the flap 42.

In certain embodiments, the flap 42 may include cuts of other shapes and geometries that provide the same overlapping effect as a slit 47 or V-shaped cut 49. These shapes may include a cut that resembles a tooth of a ripsaw blade and a scalloped cut.

In some embodiments, a pair of flaps 42 extend from opposite sides of the central portion 24. The flaps 42 may be foldable downwardly, as illustrated by arrows 44, such that the flaps 42 overlay one or more tabs 38. In some embodiments, at least one flap 42 adheres to one or more tab 38. In some embodiments, one or more flaps 42 are folded downwardly first and the first strip 30 and/or second strip 31 is/are subsequently folded downwardly, such that at least one tab 38 overlays and is adhered to at least one flap 42. Thus, the overlapping of the flaps 42 and tabs 38 may have the effect of covering or sealing seams to provide an effective moisture barrier and protective cover.

Figure 1C:
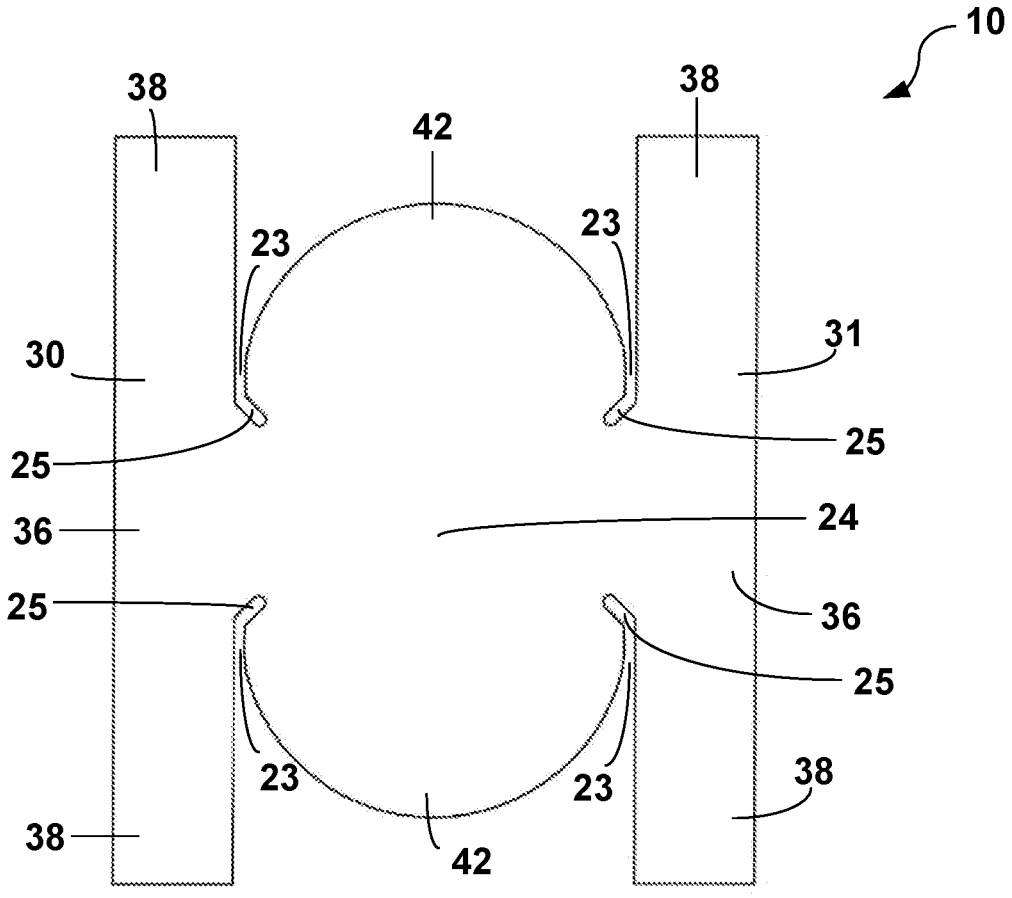
FIG. 1C provides a plan view of a pole cap prior to installation, in accordance with an example embodiment of the present invention.
Figure 2:
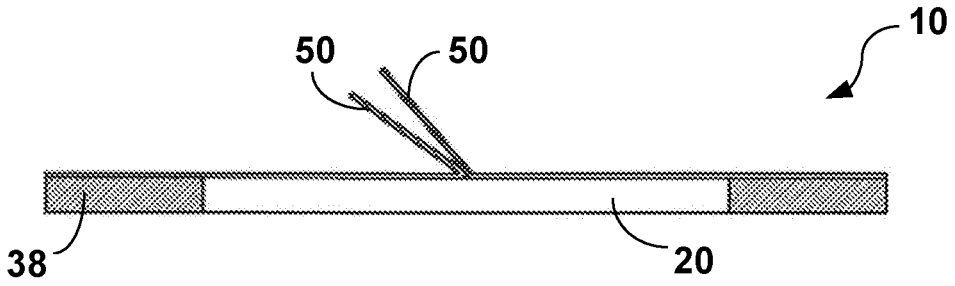
FIG. 2 provides an enlarged edge view, taken along line 2-2, of a pole cap prior to installation, in accordance with an example embodiment of the present invention.

Certain embodiments, such as the one shown in FIG. 1C, may comprise an angled cutout 25. In some embodiments, the angled cutout 25 can be angled inwardly toward the central portion 24. In some embodiments, the angled cutout 25 may meet the cutout 23 and can be angled with respect to the cutout 23. Certain embodiments may have an angled cutout 25 with an angle in the range of range of 5 to 30 degrees, while some embodiments may have an angled cutout 25 with an angle in the range of 31 to 60 degrees. Some embodiments may have an angled cutout 25 with an angle in the range of 61 to 89 degrees. It should be noted that any variation in the degree of the angle of the angled cutout 25 is herein contemplated. Further, embodiments including an angled cutout 25 may comprise a "whole" flap 42 or may include a cut in at least one of the flaps 42, such as a slit 47 or V-shaped cut 49.

The first layer 20 may be composed of an elastomeric material such that the first layer 20 may be stretched during application. Such an elastomeric property may provide an effective moisture barrier for a utility pole 14. The elastomeric property may also enable a single size first layer 20 to be applicable to a broad range of pole sizes.

In certain embodiments, a pole cap 10 may provide an effective moisture barrier that effectively protects against ultraviolet light damage without a second layer 22. Some embodiments, however, may comprise a second sheet 22.

The second layer 22 may be thin relative to the first layer 20. In some embodiments, the second layer 22 can be sized and disposed to cover certain areas of the first layer 20, which may include the central portion 24 and the central sections 36 of the first strip 30 and/or second strip 31. The second layer 22 can also have cutouts, identified in FIGS. 1A and 1B at 23, which generally correspond to the shape and configuration of the first layer 20. In certain embodiments, the second layer 22 is attached to the adhesive or sticky upper surface 26 of layer 20. The second layer 22 may have a non-adhesive or non-sticky upper surface 46, which could provide a non-sticky upper surface when the pole cap 10 is attached to a utility pole 14. The width 48 of the second layer 22 may, in some embodiments, be at least as great as the diameter of the upper end surface 16 of a typical utility pole 14.

In certain embodiments, the second layer 22 may be composed of a material that affords protection against ultraviolet light. In some embodiments, the second layer 22 is composed of polyethylene.

In some embodiments, the pole cap 10, with or without the second layer 22, is packaged as a generally planar article between a pair of backing or release sheets 50, which may ease storage, transportation, and handling prior to and during installation.

During installation, a protective fluid may be applied to the top of the utility pole 14. The pole cap 10, may be applied by removing the release sheets 50 and positioning the pole cap 10 such that the central portion 24 overlays and covers the upper end surface 16 of the utility pole 14. The lower surface 28 of the first layer 20 may then be adhesively attached to the upper end surface 16 by pressing upon the first layer 20. The first strip 30 and/or second strip 31 may then be folded downwardly generally along fold lines 32, and the central sections 36 may then be adhesively attached to the curved circumferential surface of the utility pole 14. The tabs 38 may be stretched to overlap one another, which may provide a tighter seal against moisture. Each tab 38 may be adhesively attached to one another and/or the pole by pressing thereon. The flaps 42 may be fold downwardly, stretched, and adhesively attached to the respective tabs 38 and/or the curved surface of the utility pole 14 by pressing thereon. Thus, the flaps 42 may cover and seal seams between the tabs 38.

Figure 5:
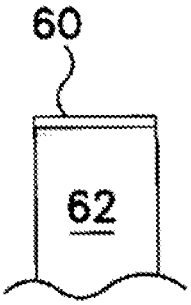
FIG. 5 provides an elevation view of an upper end of a pole with a pole cap being thereon, in accordance with an example embodiment of the present invention.

FIG. 5 depicts an example embodiment in which a pole cap 60 comprises a flat sheet of adhesive material, similar to the material of which the first layer 20 is composed. The flat sheet of the pole cap 60 may be sized and dimensioned such that it covers the upper end surface 16 of the utility pole 14. Such an embodiment may provide a less expensive option to protect the top of a pole due to a decrease in materials necessitated by its design.

Figure 6:
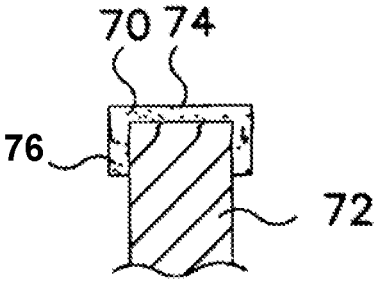
FIG. 6 provides a vertical sectional view of an upper end of a pole with a pole cap installed thereon, in accordance with an example embodiment of the present invention.

FIG. 6 depicts an example embodiment in which a pole cap 70 comprises a flat sheet of adhesive material, similar to the material of which the first layer 20 is composed. The flat sheet of the pole cap 70 has a diameter greater than that of the pole 72 so as to provide a skirt portion 76, which may be folded downwardly about the circumference of the pole 72 and adhered to the side of the top of the pole 72. The skirt portion 76 may comprise one or more notches or slits 47, which may eliminate or reduce ripples or ridges in the skirt portion 76 upon application of the pole cap 70 to the pole 72. During application, the area of the skirt portion 76 to one side of the slit 47 may first be applied, and the area of the of the skirt portion 76 to the other side of the slit 47 may be subsequently applied, such that an overlap may be formed, similar to the overlap 51 depicted in FIG. 4.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. Instead, it is intended that the invention is defined by the claims appended hereto.

We claim:

1. A pole cap for covering an end of a pole, the pole cap comprising:

a sheet comprising:

a central portion configured to cover an end surface of the end of the pole;

a first strip configured to fold over an edge of the end surface and circumferentially wrap around a portion of a curved surface of the pole; and a flap configured to fold over the edge of the end surface, wherein the flap has an outer edge that is located a first distance from an outer edge of the central portion and the flap comprises a slit extending inwardly a second distance from the outer edge of the flap toward the central portion, the second distance being less than the first distance.

2. The pole cap of claim 1, wherein the sheet further comprises an adhesive.

3. The pole cap of claim 2, wherein the adhesive is an adhesive film.

4. The pole cap of claim 1, wherein the flap has a first portion located on one side of the slit and a second portion located on the other side of the slit, the first portion configured to overlap at least some of the second portion when the flap is folded over the edge of the end surface.

5. The pole cap of claim 1, wherein the slit is a V-shaped cut.

6. The pole cap of claim 1, wherein the flap is configured to overlap at least some of the first strip when the pole cap is in an installed configuration.

7. The pole cap of claim 1, wherein the sheet further comprises a second strip, the first strip and the second strip both comprise a tab, and the tab of the second strip is configured to overlap at least a portion of the tab of the first strip when the pole cap is in an installed configuration.

8. The pole cap of claim 1, wherein the sheet is composed of a moisture-resistant material.

9. The pole cap of claim 1, wherein the sheet is composed of a plastic.

10. The pole cap of claim 1, wherein the sheet is composed of polyethylene.

11. The pole cap of claim 1, wherein the sheet is composed of butyl rubber.

12. The pole cap of claim 1, wherein the central portion is configured to contact substantially all of the end surface of the end of the pole when the pole cap is installed.

13. A pole cap for covering an end of a pole, the pole cap comprising:

a sheet comprising:

a central portion configured to cover an end surface of the end of the pole;

a first strip configured to fold over an edge of the end surface and circumferentially wrap around a portion of a curved surface of the pole;

a first cutout separating at least a part of the central portion and at least a part of the first strip, the first cutout comprising an angled notch; and a flap configured to fold over the edge of the end surface.

14. The pole cap of claim 13, wherein the angled notch extends inwardly toward the central portion.

15. The pole cap of claim 13, wherein the flap comprises a slit.

16. The pole cap of claim 13, wherein the flap comprises a V-shaped cut.

17. The pole cap of claim 13, wherein the sheet further comprises:

a second strip; and a second cutout separating at least a part of the central portion and at least a part of the second strip, wherein the first strip and the second strip both comprise a tab and the tab of the second strip is configured to overlap at least a portion of the tab of the first strip when the pole cap is in an installed configuration.

18. The pole cap of claim 13, wherein the central portion is configured to contact substantially all of the end surface of the end of the pole when the pole cap is installed.

* * * * *